US007321662B2

(12) United States Patent
Lundh et al.

(10) Patent No.: US 7,321,662 B2
(45) Date of Patent: Jan. 22, 2008

(54) HEARING AID FITTING

(75) Inventors: Peter Lundh, Hellerup (DK); Don Schum, Hellerup (DK)

(73) Assignee: Oticon A/S, Smørum (DK)

( * ) Notice: Subject to any disclaimer, the term of this patent is extended or adjusted under 35 U.S.C. 154(b) by 561 days.

(21) Appl. No.: 10/481,326

(22) PCT Filed: Jun. 28, 2002

(86) PCT No.: PCT/DK02/00454

§ 371 (c)(1),
(2), (4) Date: Feb. 17, 2004

(87) PCT Pub. No.: WO03/003792

PCT Pub. Date: Jan. 9, 2003

(65) Prior Publication Data

US 2004/0179707 A1 Sep. 16, 2004

(30) Foreign Application Priority Data

Jun. 28, 2001 (DK) ..... 2001 01016

(51) Int. Cl.
*H04R 25/00* (2006.01)

(52) U.S. Cl. ..... 381/314; 381/312

(58) Field of Classification Search ..... 381/312, 381/314

See application file for complete search history.

(56) References Cited

U.S. PATENT DOCUMENTS 5,838,801 A 11/1998 Ishige et al.
5,903,655 A * 5/1999 Salmi et al. ..... 381/321
5,991,417 A 11/1999 Topholm
6,201,875 B1 3/2001 Davis et al.

FOREIGN PATENT DOCUMENTS

| | | |
|---|---|---|
| EP | 0503536 | 9/1992 |
| WO | 0156331 | 8/2001 |
| WO | 0239784 | 5/2002 |

* cited by examiner

*Primary Examiner*—Sinh Tran
*Assistant Examiner*—Walter F Briney, III
(74) *Attorney, Agent, or Firm*—Dykema Gossett PLLC

(57) ABSTRACT

The invention relates to a fitting equipment for fitting a hearing aid, the equipment comprising a computer having a display, where the computer is provided with a fitting software adapted for controlling parameters of the hearing aid upon control of indicators in the software, where the indicators are visible on the display, where a default fitting rationale may be chosen and where in the fitting software at least two variant settings which are offset in relation to the default setting are provided and may be activated from the software by means of the computer, where in the first variant setting the release time in both the LF and HF channels are lengthened and the amount of gain for soft inputs is reduced in both the LF and HF channels and where in the second variant setting the release time in the HF is shortened and the soft gain is increased in both the LF and HF channels.

8 Claims, 1 Drawing Sheet

HEARING AID FITTING

FIELD OF THE INVENTION

The invention relates to the fitting of hearing aids, and more particularly to equipment for fitting hearing aids to the specific needs of hearing impaired individuals.

BACKGROUND OF THE INVENTION

Most modem hearing aids are programmable for adaptation to the hearing aid user's needs. Rationales have been developed; which provide a good first approach to the fitting of the hearing aid to the user. The rationales are data sets specifying the transfer function or the gain of the hearing aid over a relevant frequency range.

Some users with severe to profound hearing losses have, however, a special need for adaptation; which goes beyond what can be achieved by means of the traditionally developed rationales. These users often have a relatively normal upper hearing threshold (normally designated the uncomfortable level (UCL)), whereas the lower hearing threshold (HTL) has been significantly offset compared to that of a normal hearing person.

Speech in everyday environments can cover a 70 dB or greater dynamic range. From the softest elements of soft speech to the most intense elements of loud speech, the listener with normal hearing uses most of his/her dynamic range throughout the day. Multi-channel non-linear processing is designed to make use of most—if not all—of this dynamic range available to the patient with sensorineural hearing loss. However, as the hearing loss moves into the severe and then profound ranges, this core assumption needs to be modified, especially for some clients.

The assumption common to the fitting of other hearing losses up to this point is that the ear should be able to make reasonable use of amplified speech information, even when compressed. Given the dramatic nature of the damage in profound hearing loss, this assumption may not always be true. The damage pattern in some ears with profound hearing loss may need a signal that is more linear whereas others may be able to make full use of a signal that is highly compressed.

The objective of the present invention is to provide equipment that can provide an improved initial setting of the hearing aid in order to achieve a faster and better fitting of the hearing aid.

SUMMARY OF THE INVENTION

According to the invention the objective of the invention is achieved by means of the fitting equipment described herein.

According to the invention the objective is further achieved by means of a software for use in connection with a fitting described herein.

DESCRIPTION OF A PREFERRED EMBODIMENT

Figure 1:
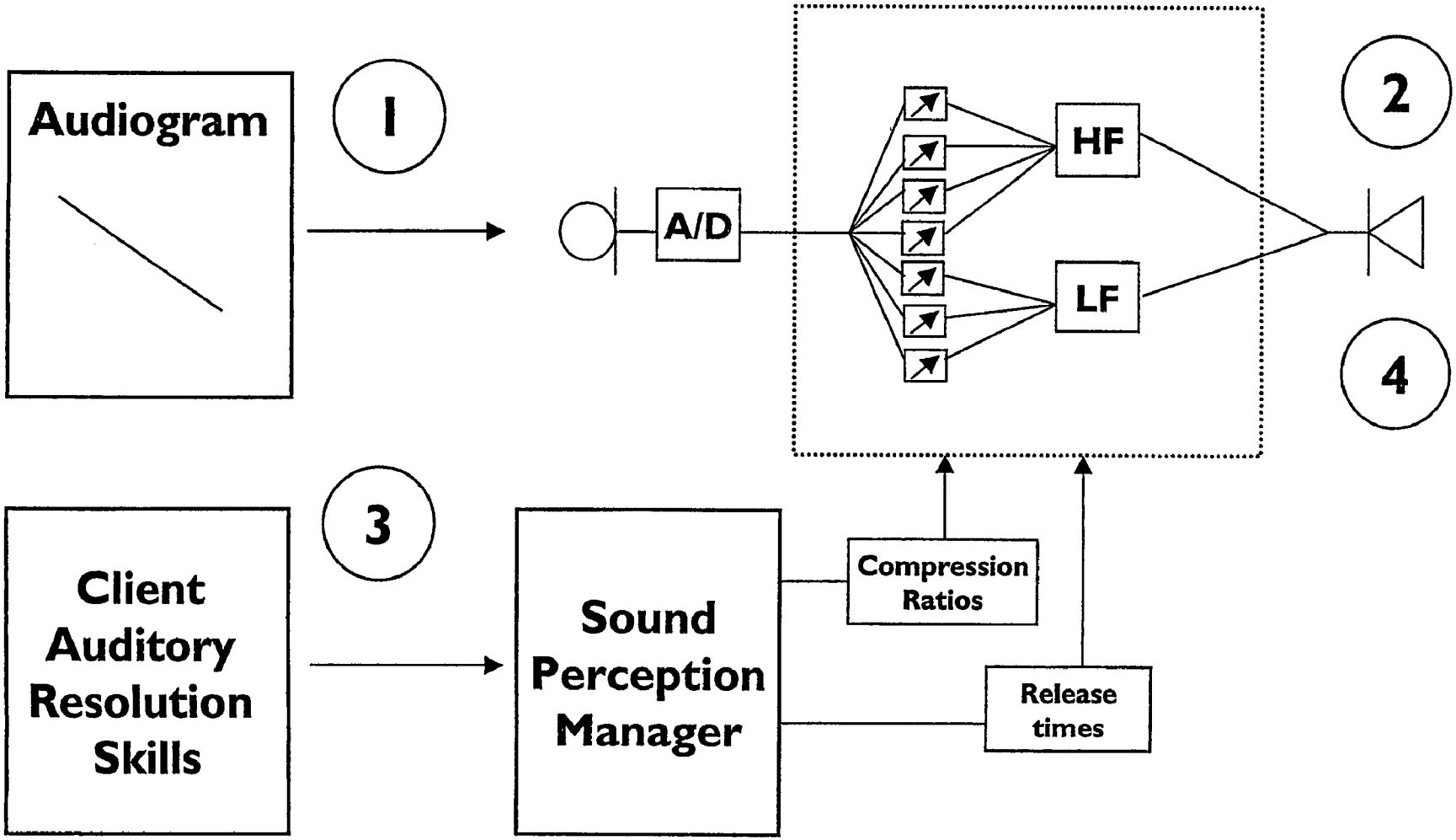
FIG. 1 is a schematic view of a fitting software display depicting the invention.

Speech in everyday environments can cover a 70 dB or greater dynamic range. From the softest elements of soft speech to the most intense elements of loud speech, the listener with normal hearing uses most of his/her dynamic range throughout the day. Multi-channel non-linear processing is designed to make use of most—if not all—of this dynamic range available to the patient with sensorineural hearing loss. However, as the hearing loss moves into the severe and then profound ranges, this core assumption needs to be modified, especially for some clients.

The assumption common to the fitting of other hearing losses up to this point is that the ear should be able to make reasonable use of amplified speech information, even when compressed. Given the dramatic nature of the damage in profound hearing loss, this assumption may not always be true. The damage pattern in some ears with profound hearing loss may need a signal that is more linear (called Type 1 clients) whereas others may be able to make full use of a signal that is highly compressed (called Type 3 clients).

Those ears that are sensitive to too much compression (called Type 1) likely have extensive damage throughout the inner ear and a minimal amount of remaining, intact inner hair cells. Signal resolution beyond the ability to detect pure-tones is very poor. These listeners probably can make use only of the peaks of the speech signal.

On the other hand, there are other ears with loss in the profound range that can actually make use of a signal that is even more compressed (called Type 3 clients). These ears probably have extensive outer hair cell loss and some amount of inner hair cell loss (accounting for the profound thresholds), but still have enough remaining signal resolution capacity to extract information from a compressed signal.

New Control with Three Settings

Based on these fundamental sound processing differences between clients, the fitting equipment or the software for the fitting equipment includes a tool in the trimmer panel. This control with three alternative settings changes the manner in which the gain, amount of compression, and compression type are implemented in the fitting:

Mode 2: For clients called Type 2 with average auditory resolution. Default for fittings and consistent with general ASA2 principles, combining fast acting syllabic compression in the LF channel with slow acting Adaptive Gain in the HF channel. The goal is to provide a modestly compressed signal to ensure adequate speech audibility for moderate and loud speech. Softer speech signals can be made more audible with use of the Manual Override (volume control wheel).

Mode 1: For clients with low auditory resolution (called Type 1). Compared to Mode 2, the release time in both the LF and HF channels are lengthened, providing a greater linear effect for short term changes in the speech signal. In addition, the amount of gain for soft inputs is reduced in both the LF and HF channels by typically around 10 dB. This effect reduces the compression ratio. The total effect of all of these changes is to make the processing act more linear on a moment-to-moment basis, and to present primarily the speech peaks to the listener, but to continue to compensate for long-term changes in the overall input speech level.

Mode 3: For clients with high auditory resolution (called Type 3). Compared to Mode 2, the release time in the HF is shortened and the soft gain is increased in both the LF and HF channels (thus increasing the compression ratios). The sum total of these changes is to pack more of the speech signal within the remaining dynamic range, assuming that the ear has sufficient remain integrity to resolve this densely compacted signal. By default, clients will be assumed to be Type 2, with fast acting compression applied in the low frequencies and slow acting compression applied in the highs.

From FIG. 1 a display appears schematically showing the activation buttons by which the client type may be selected.

The following tables depict a preferred embodiment of the settings, which are selected by selecting the client type

| | Mode 1 | Mode 2 | Mode 3 |
|---|---|---|---|
| | SOFT GAIN | | |
| | −8 dB | X | +3 dB |
| | RELEASE TIMES [ms] | | |
| LF | 160 | 80 | 80 |
| HF | 640 | 320 | 80 |

From FIG. 1 the general principles appear. The hearing aid is initially set according to the actual hearing loss. This is Mode 2. Based on the hearing impaired individuals auditory resolution skills the hearing aid professional is able to select one of the two possibilities of variant settings, which are Mode 1 or Mode 3. Hereby the compression ratios and the release times may be changed in a reliable manner without any discomfort for the hearing impaired.

The invention claimed is:

1. A hearing system including a fitting equipment and a hearing aid, the fitting equipment comprising a computer having a display, where the computer is provided with a fitting software adapted for controlling parameters of the hearing aid upon control of indicators in the software, where the indicators are visible on the display, where a control with three alternative settings are selectable to change the manner in which the gain, amount of compression, and compression type are implemented in the fitting, in that a default fitting rationale is selectable and may be chosen and where further, in the fitting software, at least two variant settings which are offset in relation to the default setting are selectable provided and may be activated from the software by means of the computer, wherein:

the default fitting combines fast acting compression in the LF channel with slow acting Adaptive Gain in the HF channel, the first variant setting combines lengthening of the release time in both the LF and HF channels with reduction of the amount of gain for soft inputs in both the LF and HF channel, and the second variant setting combines shortening of the release time in the HF channel with increase of soft gain in both the LF and HF channels.

2. A hearing system according to claim 1, wherein the release times are increased by more than 50% a in a first variant setting in both the LF and the HF area and wherein the release times are reduced by more than 50% in the HF area in a second variant setting.

3. A hearing system according to claim 1, wherein the soft gain is reduced by 3 dB, in a first variant setting and wherein the soft gain is increased by more than 1 dB, in a second variant setting.

4. A hearing system according to claim 3, wherein the soft gain is reduced by about 8 dB in the first variant setting and increased by about 3 dB in the second variant setting.

5. A method of fitting a hearing aid comprising:

controlling parameters of the hearing aid upon control of indicators visible on a computer display;

selecting one of three alternative settings thereby changing a manner in which gain, amount of compression, and compression type are implemented in the hearing aid, in that a default fitting setting is available and may be chosen; and activating at least two variant settings which are offset in relation to the default fitting setting by means of a computer, wherein the default fitting setting combines fast acting compression in a LF channel with slow acting Adaptive Gain in a HF channel, the first variant setting combines lengthening of the release time in both the LF and HF channels with reduction of the amount of gain for soft inputs in both the LF and HF channels, and the second variant setting combines shortening of the release time in the HF channel with increase of soft gain in both the LF and HF channels.

6. A method according to claim 5, where the release times are increased by more than 50% in a first variant setting in both the LF and the HF area and where the release times are reduced by more than 50% in the HF area in a second variant setting.

7. A method according to claim 5, wherein the soft gain is reduced by 3 dB, in a first variant setting and wherein the soft gain is increased by more than 1 dB, in a second variant setting.

8. A method according to claim 7, wherein the soft gain is reduced by about 8 dB in the first variant setting and increased by about 3 dB in the second variant setting.

* * * * *